US005266294A

United States Patent [19]

Schulz et al.

[11] Patent Number: 5,266,294

[45] Date of Patent: Nov. 30, 1993

[54] CONTINUOUS, ULTRAHIGH MODULUS CARBON FIBER

[75] Inventors: David A. Schulz, Fairview Park; Loren C. Nelson, Strongsville, both of Ohio

[73] Assignee: Amoco Corporation, Chicago, Ill.

[21] Appl. No.: 821,463

[22] Filed: Jan. 15, 1992

Related U.S. Application Data

[63] Continuation of Ser. No. 324,401, Mar. 15, 1989, abandoned, which is a continuation of Ser. No. 280,942, Dec. 7, 1988, abandoned, which is a continuation-in-part of Ser. No. 129,532, Dec. 7, 1987, abandoned, which is a continuation-in-part of Ser. No. 846,511, Mar. 31, 1986, abandoned, which is a continuation of Ser. No. 605,064, Apr. 30, 1984, abandoned.

[51] Int. Cl.[5] ..... D01F 9/12

[52] U.S. Cl. ..... 423/447.1; 423/447.2; 423/447.4; 423/447.6; 423/448; 264/292

[58] Field of Search ..... 423/447.1, 447.2, 447.4, 423/447.6, 448; 264/29.2

[56] References Cited

U.S. PATENT DOCUMENTS

| | | | |
|---|---|---|---|
| 3,107,152 | 10/1963 | Ford et al. | 23/209.2 |
| 3,595,946 | 7/1971 | Joo et al. | 264/29 |
| 3,664,900 | 5/1972 | Cuckson et al. | 156/174 |
| 3,702,832 | 11/1972 | Ermoleuko et al. | 252/423 |
| 3,974,264 | 8/1976 | McHenry | 423/447.4 |
| 3,975,482 | 8/1976 | Rulison | 264/131 |
| 4,005,183 | 1/1977 | Singer | 423/447.2 |
| 4,014,725 | 3/1977 | Schulz | 156/148 |
| 4,026,788 | 5/1977 | McHenry | 208/39 |
| 4,073,869 | 2/1978 | Kalnin | 423/447.1 |
| 4,138,525 | 2/1979 | Schulz | 428/367 |
| 4,209,500 | 6/1980 | Chwastiak | 423/447.6 |
| 4,275,051 | 6/1981 | Barr | 423/447.4 |
| 4,276,278 | 6/1981 | Barr et al. | 423/447.4 |
| 4,351,816 | 9/1982 | Schulz | 423/447.4 |
| 4,389,387 | 6/1983 | Miyamori et al. | 423/447.7 |
| 4,606,808 | 8/1986 | Yamada et al. | 208/44 |
| 4,686,096 | 8/1987 | Schulz et al. | 423/447.1 |
| 4,915,926 | 4/1990 | Lahijani | 423/447.1 |
| 4,923,692 | 5/1990 | Nakagoshi et al. | 423/447.4 |

FOREIGN PATENT DOCUMENTS

| | | | |
|---|---|---|---|
| 69-2510 | 2/1969 | Japan . | |
| 60-173121 | 9/1985 | Japan | 423/447.6 |
| 61-236605 | 10/1986 | Japan | 423/448 |
| 717853 | 11/1971 | South Africa . | |
| 1177739 | 1/1970 | United Kingdom . | |

*Primary Examiner*—Robert Kunemund

*Attorney, Agent, or Firm*—Richard J. Schlott; Stephen L. Hensley

[57] ABSTRACT

High modulus, pitch-based, continuous carbon fiber having a density above about 2.18 g/cc and an electrical resistivity below about 1.6 micro-ohm-meter, and a method for making.

8 Claims, No Drawings

CONTINUOUS, ULTRAHIGH MODULUS CARBON FIBER

CROSS REFERENCE TO RELATED APPLICATIONS

This application is a continuation of U.S. application Ser. No. 07/324,401, filed Mar. 15, 1989, now abandoned; which was a continuation of U.S. application Ser. No. 07/280,942, filed Dec. 7, 1988, now abandoned which was a continuation-in-part of U.S application Ser. No. 7/129,532, filed Dec. 7, 1987, now abandoned; which was a continuation-in-part of U.S. application Ser. No. 06/846,511, filed Mar. 31, 1986, now abandoned; which was a continuation of U.S. application Ser. No. 06/605,064, filed Apr. 30, 1984, now abandoned.

BACKGROUND OF THE INVENTION

This invention relates to carbon fibers and more particularly to continuous pitch-based carbon fibers having a high modulus and low electrical resistivity and methods for the production of such fibers, and to composites comprising such fibers.

Carbon fibers have long been known, and methods for their production from a variety of precursors are well described in the art. Cellulosic precursors have been used for producing carbon fiber since the early 1960's, with rayon being the dominant carbon fiber precursor for nearly two decades. More recently, as the art has developed methods for producing carbon fiber derived from such materials as polyacrylonitrile (PAN) and pitch, the importance of rayon-based carbon fiber has declined. This shift has been due in part to the superior toughness, tensile strength and stiffness exhibited by both PAN-based and pitch-based carbon fiber. In addition, the conversion yield of rayon to carbon fiber is low, and the resulting carbon fiber is ordinarily lower in density than carbon fiber based on PAN or pitch, which further limits its potential uses.

It is known that the tensile modulus of carbon fiber generally increases with increasing density, as does the thermal conductivity, while the electrical resistivity of carbon fiber decreases as fiber density is increased. Carbon fiber with high thermal conductivity has found use in applications where heat dissipation is a requirement such as, for example, in the manufacture of heat sinks and in brake pad applications, while fiber with a high degree of stiffness lends greater dimensional stability to composites. Considerable effort has therefore been expended to achieve carbon fibers with these high densities reproducibly and with good control.

Polyacrylonitrile fiber, when oxidized and carbonized under appropriate conditions, provides tough, high strength, high modulus carbon fiber. The overall conversion yield in producing fiber from PAN is good, and the finished fiber is capable of achieving the outstanding tensile strength needed for producing the high performance composite materials used in a variety of sports, automotive and aircraft applications. However, the tensile modulus of commercially available PAN-based fiber does not generally exceed about $50\times10^6$ psi, which is somewhat deficient for use in applications that require a high degree of stiffness. Moreover, PAN-based carbon fibers generally exhibit densities of less than 1.9, together with low thermal conductivity, ordinarily less than 200 w/m-°K, and high electrical resistivity.

Pitch-based carbon fiber has generally been recognized as capable of providing greater stiffness and higher thermal conductivity than carbon fiber from other sources, and considerable effort has been directed toward the development of pitch-based ultra-high modulus carbon fibers with good thermal conductivity. Such carbon fibers could find immediate application in forming composites for use where good dissipation of electrical charges or heat is desired. In addition, the combination of high stiffness and good thermal conductivity with the negative coefficient of thermal expansion characteristically exhibited by pitchbased fibers would make such composites extraordinarily dimensionally stable.

The continuous carbon fibers heretofore disclosed and described in the art, including those carbon fibers having tensile modulus values as great as about 120 to $125\times10^6$ psi which have been designated as "ultra-high modulus", have generally exhibited densities of less than about 2.2 g/cc, thermal conductivities of less than about 1000 w/m-°K and electrical resistivities generally above about 1.8 micro-ohm-meter. For most high modulus, pitch-based carbon fibers produced in commercial facilities, the thermal conductivity ordinarily falls below about 700 w/m-°K, and the electrical resistivity is generally above 2.0 microohm-meter. Although there has recently been reported in the art pitch-based carbon fiber having a tensile modulus substantially above about $125\times10^6$ psi, with single carbon fiber filament values as great $140\times10^6$ psi, these fibers also generally do not exhibit low electrical resistivity characteristics, and the thermal conductivity of these fibers is also reported to be low, generally below 1000 w/m-°K.

Crystalline graphite has a density of about 2.26 g/cc, and generally exhibits excellent thermal conductivity, near 1800 w/m-°K, and low electrical resistivity, well below 1.5 micro-ohm-meter. However, even though methods for producing graphite whiskers having extremely high modulus together with conductivity and density properties near those of single graphite crystals are known, the art has not suggested the preparation of continuous carbon fibers from pitch or any other source with a density of 2.2 g/cc or greater, a thermal conductivity well above 1100 w/m-°K and an electrical resistivity significantly below 1.5 micro-ohm-meter, to as low as 1.2 micro-ohm-meter and lower.

A carbon fiber having a density of about 2.2 or greater and an electrical resistivity below 1.5 micro-ohm-meter, together with a tensile modulus well above $125\times10^6$ psi and even as great as $130\times10^6$ psi or greater would be a substantial advance in the carbon fiber art. Such carbon fiber, and particularly fiber exhibiting a thermal conductivity greater than 1100 w/m-°K, would find immediate wide acceptance for use in a variety of composite applications, and would be particularly useful for composites in which good dimensional stability and low electrical resistivity are needed.

SUMMARY OF THE INVENTION

The carbon fibers of this invention are high modulus, pitch-based continuous carbon fibers having a very high thermal conductivity, and a low electrical resistivity. The carbon fibers and woven fabric reinforcement made from such fibers are particularly useful for the production of composites.

DETAILED DESCRIPTION

The carbon fibers of this invention are pitch-based continuous carbon fibers having a density of not less than 2.18 g/cc, a tensile modulus substantially above $120\times10^6$ psi, and an electrical resistivity below about 1.6 microohm-meter. More particularly, the continuous carbon fibers of this invention have a density in the range of from about 2.18 g/cc to the limiting density of crystalline graphite, about 2.26 g/cc, a tensile modulus greater than $125\times10^6$ psi and an electrical resistivity below about 1.5 microohm-meter. Preferably, the continuous carbon fibers of this invention will have a density in the range of from about 2.2 to about 2.26 g/cc, a tensile modulus in the range of from about $125\times10^6$ psi to about $150\times10^6$ psi, and an electrical resistivity in the range of from 1.5 to about 0.95, more preferably from about 1.2 to about 0.95 micro-ohm-meter. The continuous carbon fibers of this invention exhibit a thermal conductivity generally in the range of about 950 to about 1800 w/m-°K, preferably above about 1000 w/m-°K, and still more preferably above about 1100 w/m-°K.

The high density, low electrical resistivity carbon fibers of this invention may be further described as being highly oriented and graphitic. The fibers have a three-dimensional order and crystalline structure characteristic of polycrystalline graphite, as will be apparent from an examination of the X-ray diffraction pattern of the fibers. Although the precise relationships are not understood, the crystallite size and the degree of crystallite orientation in the fiber, as well as the degree of crystallinity, appear to affect the level of electrical resistivity and thermal conductivity that may be achieved.

The high density carbon fibers of this invention may be produced from high purity, high softening temperature mesophase pitch using improved spinning techniques and a sequence of controlled heating steps whereby the pitch is spun to form a fiber, infusibilized and then carbonized.

High purity, high softening temperature mesophase pitch suitable for use in producing the carbon fibers according to the practice of this invention can be obtained from petroleum hydrocarbon or coal tar sources. A variety of methods for preparing a suitable pitch are well known, including those disclosed in U.S. Pat. Nos. 3,974,264, 4,026,788, and 4,209,500, and any of these methods as well as the variety of solvent-based methods known in the art may be employed for these purposes. Several methods have been used in the art to characterize the mesophase component of pitch, including solubility in particular solvents and degree of optical anisotropy. The mesophase pitch useful in the practice of this invention preferably comprises greater than 90 wt % mesophase, and preferably will be a substantially 100 wt % mesophase pitch, as defined and described by the terminology and methods disclosed by S. Chwastiak et al in Carbon 19, 357-363 (1981). The pitch can also be described as having a high softening temperature, preferably greater than about 340° C., and more preferably above about 345° C., although when derived from coal tar sources a pitch having a somewhat lower softening temperature may also be useful. For the purposes of this invention, the pitch will be thoroughly filtered to remove infusible particulate matter and other contaminants that may contribute to the formation of defects and flaws in the fiber.

The pitch is spun from the melt using conventional methods, in general by forcing the molten pitch through a spinnerette while maintaining the pitch at a temperature well above the softening temperature. However, the temperatures useful for spinning generally lie in a narrow range and will vary, depending in part upon the viscosity and other physical properties of the particular pitch being spun. Those skilled in the art of melt-spinning will recognize that even though the pitch may be in a molten state, it may be too viscous or may have insufficient strength in the melt to form a filament and may even decompose or de-volatilize to form voids and other flaws when the pitch temperature is outside the temperature range useful for spinning that pitch. Thus it has long been a necessary and standard practice in the art to conduct initial tests to establish the temperature range that will be effective for melt spinning the particular pitch being employed. For the purposes of this invention, the pitch will preferably be spun at or near the highest temperature within in the effective range of spinning temperatures at which the pitch may be spun. The degree of orientation of the mesophase domains in the spun pitch fiber appears to increase in proportion to spinning temperature, and a high spinning temperature is therefore desirable to obtain the very high degree of orientation of the mesophase domains within the fiber structure for the purposes of this invention.

While not wishing to be bound by any particular theory of operation, it appears that the degree of crystallization that may take place within the pitch fiber during the subsequent thermal carbonization steps to form microcrystalline graphite, as well as the size of the crystallites that may form, is related to size of the mesophase domains in the pitch fiber and the degree of orientation of the mesophase domains. Thus, pitch fibers having large, well-oriented mesophase domains tend form fibers comprising larger, more compact graphitic microcrystals upon being carbonized. The size, and particularly the length of the mesophase domains as determined by $L_c$, and the degree of domain orientation in the pitch fiber appear in turn to be determined at least in part by the conditions employed for spinning the pitch fiber, with the domain size and degree of domain orientation in the pitch fiber as well as the density of the resulting carbon fiber appearing to increase as the temperature of fiber spinning is increased. The spinning temperature range for a particular pitch will generally rise as the softening temperature of the pitch is increased, and the use of mesophase pitch materials having a high softening temperature will thus be preferred.

It is well known that pitch tends to polymerize when heated, and to coke, particularly when exposed to an oxidizing environment while hot. Polymerization may in turn increase the melt viscosity of the pitch, making spinning difficult or impossible, while coking of the pitch forms infusible particles that contribute to flaws in the fiber and may block the spinnerette. The spinning process will therefore preferably be conducted using melting and heating operations designed and optimized to protect the molten pitch from exposure to air or other oxidizing conditions during the spinning operations, and to minimize the time the pitch is exposed to elevated temperatures.

A variety of methods are known for converting pitch fiber to carbon fiber, including those described for example in U.S. Pat. Nos. 4,005,183, 4,209,500, 4,138,525 and 4,351,816, the teachings of which are incorporated herein by reference. In the practice of conventional carbon fiber processes, it is generally necessary to first infusibilize the thermoplastic pitch fiber filaments in an oxidation step, such as by heating in an oxidizing gas atmosphere at a temperature in the range of from 200° to 400° C. The infusibilized pitch fiber is then carbonized by further heating in the absence of any oxidizing gas. The carbonizing steps may be carried out by heating the fiber in bulk, for example by winding the infusibilized yarn on a bobbin prior to the heating step, by a threadline operation, or by a combination of bulk and threadline operations.

Conventionally, the carbonizing step has been conducted in the art by heating in the substantial absence of air or other oxidizing gases, and preferably in a substantially inert gas atmosphere, to a temperature in the range of from 1000° to 1900° C., and graphitizing by heating at further elevated temperatures. The heating steps are generally conducted to specified temperatures at a carefully controlled rate, particularly before and during the carbonizing step in order to avoid melting or otherwise causing damage to the fiber.

Alternative processes for infusibilizing the pitch fiber have been described more recently, for example in published European patent application 85 200867.3. According to the disclosure therein, the pitch fiber is infusibilized by treatment with a liquid oxidizing composition, preferably comprising aqueous nitric acid, and then carbonized. The subsequent carbonizing and graphitizing operations using pitch fiber infusibilized with liquid oxidizing composition may be be conducted according to the processes disclosed and described in the U.S. patents set forth herein above. In the alternative, the infusibilized fiber may be carbonized and graphitized in a single operation whereby the fiber is wound on a suitable spool and heated under controlled conditions to a temperature above 2000° C., preferably above 3000° C. to accomplish the graphitization step.

In a preferred embodiment of the aforesaid alternative process for infusibilizing the pitch fiber, the liquid oxidizing composition comprises an aqueous solution of nitric acid. Nitric acid is relatively inexpensive and may be readily obtained in concentrated form from commercial sources. The concentrated acid will be diluted with water, preferably with deionized or distilled water to avoid introducing undesirable contaminants, to achieve the desired concentration.

The concentration of nitric acid employed will depend in part upon the length of time the pitch will be exposed to the nitric acid, as well as on the amount of aqueous nitric acid that will be added per unit weight of fiber and the degree of drying that will take place before the heat treatment is carried out. Although a concentration of as low as 10 wt % may be used, concentrations of at least 15 wt % will ordinarily be needed to achieve adequate oxidation and reduced fiber sticking. Still more preferred to accomplish adequate treatment in a reasonable length of time will be concentrations above about 20 wt % and preferably in the range of from about 20 to about 30 wt %. For most commercial operations, where the time between the application of the acid to the pitch yarn and the heat treatment will be in the range of from one to about five days, a concentration of approximately 25 wt % will be suitable. Under circumstances where the duration of the exposure of the fiber to acid before the heat treatment is expected to be brief, thus requiring that the oxidation be accomplished quickly, or when the amount of aqueous nitric acid composition that will be added per unit weight of fiber will be low in order to achieve a high rate of fiber production, the concentration of the nitric acid may be further increased above 30 wt % to as much as 40 wt %. However, the treatment of carbonaceous materials such as pitch with high nitric acid concentrations may increase the likelihood of a rapid, exothermic and possibly sudden or even explosive decomposition of the oxidized materials and hence excessive concentrations of nitric acid are to be avoided.

Some form of surface treatment for the pitch fibers may be desirable to minimize the occurrence of "sticking" or fusion during the subsequent heat treatment. For example, the liquid oxidizing composition may include carbon black or colloidal graphite particles and a surfactant for these purposes. The particles serve to separate the pitch filaments and thereby reduce sticking, and the surfactant may be useful for maintaining the particles as a uniform dispersion in the composition, as well as aiding the flow of the oxidizing composition over the fibers. A variety of suitable anionic and nonionic surfactants are well known and widely available, typically including various water soluble sodium and ammonium salts of compounds such as tetramethyl oleic acid, lauric acid and the like. Other alternative surface treatments that may be useful include the application of a sizing composition to the pitch fibers, either with the liquid oxidizing composition or in a subsequent step.

A variety of methods for applying the liquid oxidizing composition to the pitch fibers including dipping, spraying, misting and the like will be readily apparent to those skilled in the art. A rotating kiss wheel, commonly employed for the application of sizing to fibers, may also be conveniently used for this purpose. The composition may also be applied to the pitch yarn in bulk after the yarn has been accumulated, such as for example by dipping or spraying the bobbin wound with fiber. A relatively loose winding of the fiber on the bobbin will be desired to allow the composition to flow more freely through the fiber.

The package or spool comprising the fiber wet with nitric acid may be heat treated directly. However, the wet fiber may contain as much as 50 wt % aqueous acid, requiring the evaporation of large quantities of water during the subsequent heating steps. It may therefore be desirable to allow the excess aqueous composition to fully drain from the spool, and to carry out an initial low temperature heating step to further dry the fiber. The drying step may be conducted in a separate operation carried out in a low temperature oven, or by placing the spool in the furnace and conducting an initial low temperature heating cycle with a sweep of inert gas to remove moisture before finally sealing the furnace, in order to reduce the potential for furnace blow-out or other furnace damage due to the presence of large quantities of steam. Since the addition of heat cycles increases energy consumption, it may be desirable as an alternative to permit the spool to undergo drying at ambient temperatures during the storage period. It will be desirable to exercise some care during the drying and storage to ensure that the wound fiber does not sag on the spool.

The heat treatment of the fiber infusibilized with aqueous nitric acid or similar liquid oxidizing composition may be conducted in a single heating step to a temperature in the range of 3000°-3500° C. to produce the high modulus fiber of this invention. The heat treatment will be conducted in a substantially non-reactive atmosphere to ensure that the fiber is not consumed. The non-reactive atmosphere may be nitrogen, argon or helium, however for temperatures above about 2000° C., argon and helium are preferred. Although the non-reactive atmosphere may include a small amount of oxygen without causing serious harm, particularly if the temperature is not raised too rapidly, the presence of oxygen should be avoided. In addition, yarn wet from being treated with liquid oxidizing composition will produce an atmosphere of steam when heated, which should be purged from the furnace before carbonizing temperatures are reached, inasmuch as steam is highly reactive at such temperatures. It may be desirable to include boron or similar graphitizing components in the furnace atmosphere and these will be regarded as non-reactive as the term is used herein.

The heat treatment used in the carbonizing and graphitizing of pitch fibers infusibilized with aqueous nitric acid or similar oxidizing composition has three broad ranges which are important in deciding a heating schedule. The rate of temperature increase up to about 400° C. should take into account that the pitch fibers may not become completely infusibilized until heated above that temperature, and too rapid heating may result in fiber deformation due to softening, fusion and disorientation of the mesophase. While the temperature increase above about 400° C. may take place at a higher rate, it must be recognized that much of the gas loss that occurs during the pyrolysis or carbonizing process takes place as the fibers are heated in the range of 400° C. to about 800° C., and too rapid an increase can result in damage due to evolving gases. Above about 800° C., to the final temperature in the range of 1100°-2000° C. for carbonized fibers, and up to 3000° and above for graphitizing, the rate of heating may be much greater, and conducted generally at as rapid a rate as may be desired.

A convenient heating schedule includes heating at an initial rate of 25° C./hr from room temperature to about 400° C., then at 50° C./hr from 400° to 800° C., and finally at a rate of 100° C./hr, or even greater if desired, over the range of from about 800° C. to the final temperature. The heating schedule also is determined in part upon the type of fiber, the size of the spools, the effective loading of the furnace and similar factors. Various further adjustments may be necessary for use of specific equipment and materials, as will also be readily apparent to those skilled in the art.

It will be recognized that although the heat treatment of the infusibilized fiber has been described as a single step process, the heating of the fiber may in the alternative be conducted in a series of steps or stages, with cooling and storage of intermediate materials such as carbonized fiber for further processing at a later time. The infusibilized fiber may also be carbonized using conventional carbonizing processes such as those described herein above.

The preparation of the ultra high modulus, high thermal conductivity fibers of this invention will be better understood by consideration of the following illustrative examples. The following examples serve only to illustrate methods for the preparation of fibers which are specific embodiments of the practice of this invention, and are not intended in any way to limit the scope of this invention.

EXAMPLES

The test methods employed in the following examples for determining strand tensile properties for continuous carbon fiber are described in ASTM D4018 and D3800.

Electrical resistivity for carbon fibers was determined by measuring the resistance per unit length of 50 and 100 cm lengths of the yarn using an ohm-meter, then calculating the yarn resistivity as the resistance multiplied by the cross-sectional area. Cross-sectional area was in turn determined from the weight per unit length, measured according to ASTM D4018 and density, measured according to ASTM D3800 using o-dichlorobenzene as the immersion liquid.

Methods for measurement of thermal conductivity of carbon fiber have been described for single filaments by L. Peraux et al in "The Temperature Variation of the Thermal Conductivity of Benzene-derived Carbon Fibers", *Solid State Communications* 50, 697-700 (1984), and for composites by B. Bozone and M. C, Flanagan in *Conference on Thermal Conductivity Methods,* Batelle Memorial Institute, pp 29-57, 1961.

Methods for determining the crystalline characteristics of materials are well known, and such methods have long been used for characterizing a variety of substances. The application of such methods to the examination of graphite and of carbon fibers has also been summarized, for example in U.S. Pat. Nos. 3,919,376 and 4,005,183, the teachings of which are incorporated herein by reference.

EXAMPLE 1

Pitch fiber yarn having 2000 filaments was spun from a 351° C. softening point mesophase pitch, using an average temperature of 401° C. The fiber was spun at an extrusion rate of 8.9 lb/hr and a takeup speed of 590 ft/min for 18 min, then at 12 lb/hr and 800 ft/min, to provide a total fiber weight of 4.1 lb. A mixture containing aqueous nitric acid (25 wt %) and 35 g/l of carbon black was applied to the fiber during the spinning operation using a kiss wheel, adding 2.6 lbs to the final weight of the pitch fiber. The fiber was wound at a low crossing angle onto a graphite bobbin covered with a ¼" thick carbon felt pad to give a diameter of 3.5". The final spool or package of fiber was tapered, 10" at the base and 4" at the top, and had an outside diameter of 6.5".

The package was placed in the top position of an induction furnace and heated in an argon atmosphere at a rate of 25°/hr to 400° C., then at 50°/hr to 800° C., and finally at 100°/hr to 3200° C. The spool was held at 3200° C. for one hour, then cooled.

The fiber had the following strand properties:

| | | |
|---|---|---|
| tensile strength | 327,000 | psi |
| tensile modulus | 125,000,000 | psi |
| yield | 0.324 | g/m |
| density | 2.20 | g/cc |
| resistivity | 1.51 | micro-ohm-meter |

EXAMPLE 2

Pitch fiber yarn having 2000 filaments was spun from a 355° C. softening point mesophase pitch, using an average temperature of 412° C. The fiber was spun at an extrusion rate of 12 lb/hr and 850 ft/min, to provide a total fiber weight of 3.8 lb. A mixture containing aqueous nitric acid (25 wt %) and 35 g/l of carbon black was applied to the fiber during the spinning operation using a kiss wheel. The fiber was wound at a low crossing angle onto a graphite bobbin covered with a ¼" thick carbon felt pad to give a diameter of 3.5". The final spool or package of fiber was tapered, 10" at the base and 4" at the top, and had an outside diameter of 6.5". The final weight of the pitch fiber package included 38 wt % aqueous acid mixture.

The package was mechanically rotated and allowed to dry at room temperature to a moisture content of about 15 wt %, and then further to a final moisture content of less than 9 wt %. The package was placed in the induction furnace and heated in an "nitrogen" atmosphere at a rate of 25°/hr to 400° C., then at 50°/hr to 800° C., then to 1300° C. and held for 24 hr before being cooled, removed from the furnace and placed in a second induction furnace. The package was again heated in an argon atmosphere at 100°/hr to 3230° C., held at 3230° C. for 2 hr, then cooled.

The fiber had the following strand properties:

| | | |
|---|---|---|
| tensile strength | 453,000 | psi |
| tensile modulus | 136,000,000 | psi |
| yield | 0.355 | g/m |
| density | 2.21 | g/cc |
| resistivity | 1.14 | micro-ohm-meter |

The resistivity of the carbon fiber is remarkably low, indicating substantial improvement in thermal conductivity. The combination of good conductivity, characterized by a resistivity value less than 1.5 micro-ohm-meter and a high tensile modulus, greater than 125,000,000 psi, found for these fibers is considerably greater has been achievable in the art to this time, and is quite surprising.

EXAMPLE 3

Pitch fiber yarn having 2000 filaments was spun from a 351° C softening point mesophase pitch, using an average temperature of 400° C. The fiber was spun at an extrusion rate of 15.4 lb/hr. The fiber was treated with aqueous nitric acid, wound on a bobbin and subjected to a first heat treatment substantially by the procedures of Example 2. The fiber was then threadline processed in a 2400° furnace for about 5 sec. using 600 g of yarn tension, wound in a parallel manner on a flanged graphite spool and heated in an argon atmosphere at 100°/hr to about 3310° C. The spool was held at about 3310° C. for one hour, then cooled.

The fiber had the following strand properties:

-continued

| | | |
|---|---|---|
| tensile strength | 376,000 | psi |
| tensile modulus | 138,000,000 | psi |
| yield | 0.311 | g/m |
| density | 2.21 | g/cc |
| resistivity | 1.47 | micro-ohm-meter |

EXAMPLE 4–6

Additional ultrahigh modulus, high density continuous carbon fibers were prepared from high softening temperature pitches, substantially following the processes of Example 3. The fiber properties and the precursor pitch data are summarized in Table I.

The use of a high softening pitch together with a high spinning temperature will be seen to contribute to the improvement of the conductivity and modulus of the fiber, as is further confirmed by the following comparative examples.

COMPARATIVE EXAMPLES

Comparative Example A. Pitch fiber yarn having 2000 filaments was spun from a 331° C. softening point mesophase pitch, using an average temperature of 372° C. The fiber was spun at an extrusion rate of 12 lb/hr, and thermoset by heating in air at an average rate of 280° C./hr to 380° C. and held for 5 min before being cooled to room temperature and wound onto a graphite bobbin.

The package was placed in the induction furnace and heated in a nitrogen atmosphere at a rate of 50° /hr to 800° C., and finally at 100° /hr to 1300° C. and held at that temperature for two hours before cooling. The fiber was threadline processed in a 2400° furnace for about 5 sec. using 600 g of yarn tension, then wound in a parallel manner on a flanged graphite spool and heated in an argon atmosphere at 100° /hr to 3080° C. The spool was held at 3080° C. for two hours, then cooled.

The carbon fiber had the following strand properties:

| | | |
|---|---|---|
| tensile strength | 293,000 | psi |
| tensile modulus | 102,000,000 | psi |
| yield | 0.322 | g/cc |
| density | 2.16 | g/cc |
| resistivity | 2.73 | micro-ohm-meter |

Comparative Examples B and C. Additional prior art carbon fibers were prepared following the procedure of Comparative Example A. The processing temperatures and spin temperatures used in preparing the pitch fibers and the physical properties of the resulting carbon fibers are summarized in Table I, together with the properties of ultrahigh modulus, low resistivity fibers of this invention.

TABLE I

| | Fiber | | | | | | Pitch | |
|---|---|---|---|---|---|---|---|---|
| Ex. No. | ten. mod (Mpsi) | resist. (μ-ohm-m) | d (g/cc) | Lc(004) | d sp Co(004) | furnace T °C. | Soft. T (°C.) | Spin T (°C.) |
| 1 | 125 | 1.51 | 2.20 | | | 3200 | 351 | 401 |
| 2 | 136 | 1.14 | 2.21 | | | 3230 | 355 | 412 |
| 3 | 138 | 1.47 | 2.21 | 183 | 3.369 | 3310 | 351 | 400 |
| 4 | (137) | 1.28 | 2.21 | 208 | 3.367 | 3343 | 350 | 405 |
| 5 | 133 | 1.23 | 2.21 | 208 | 3.369 | 3521 | 348 | 404 |
| 6 | (134) | 1.15 | 2.20 | 221 | 3.364 | 3345 | 350 | 409 |
| A | 102 | 2.73 | 2.16 | 124 | 3.379 | 3280 | 331 | 372 |
| B | (124) | 2.05 | 2.17 | 151 | 3.372 | 3240 | 332 | 375 |

TABLE I-continued

| Ex. No. | Fiber ten. mod (Mpsi) | resist. (μ-ohm-m) | d (g/cc) | Lc(004) | d sp Co(004) | furnace T °C. | Pitch Soft. T (°C.) | Spin T (°C.) |
|---|---|---|---|---|---|---|---|---|
| C | 129 | 1.75 | 2.18 | 158 | 3.371 | 3310 | 332 | 379 |

Notes:
ten. mod. = tensile modulus; values in ( ) are tangent modulus values, measured at 150 kpsi stress; Mpsi = psi × $10^{-6}$. X-ray data for Examples 1 and 2 determined on fiber; Examples 3–6 and A–C are for composites; Lc(004) and d sp(acing) Co(004) were determined from 004 reflections. Fibers were maintained at furnace T(emperature) for 2 hrs, except Ex. Nos. 1, 3 and 5, which were maintained for 1 hr.

It will be seen from a consideration of the physical properties of the carbon fiber of Comparative Examples A–C that the prior art high modulus carbon fibers exhibit a high resistivity, well above the resistivity values for the carbon fiber of this invention, and a density below about 2.2 g/cc.

In the following examples, commercial pitch-based carbon fibers were heated at graphitizing temperatures to determine the effect of repeated thermal treatment on prior art carbon fiber modulus and electrical resistivity.

Comparative Example "D". A commercial high modulus, continuous pitch-based carbon fiber was obtained from Amoco Performance Products Inc. as Thornel P-120 carbon fiber having a tensile strength of 364 kpsi, a tensile modulus of $122\times10^6$ psi, a resistivity of 1.801 micro-ohm-meter, a density of 2.173 g/cc, and a d spacing Co (004) of 3.375 Å. The fiber was heat treated for about 2 hrs in a furnace held at 3330° C., after which the resistivity was 1.776 micro-ohm-meter, the density was 2.186 g/cc and the d spacing Co (004) was 3.371.

Comparative Example "E". A commercial high modulus, continuous pitch-based carbon fiber was obtained from Amoco Performance Products Inc. as Thornel P-100 carbon fiber having a tensile strength of 350 kpsi, a tensile modulus of $110\times10^6$ psi, a resistivity of 2.31 micro-ohm-meter, a density of 2.168 g/cc, and a d spacing Co (004) of 3.379 Å. After the fiber was heat treated about 1 hr in an oven maintained at 3000° C., the tensile modulus was $110\times10^6$ psi, the resistivity was measured as 2.05 micro-ohm-meter, the density was 2.167 g/cc and the d spacing Co (004) was 3.377 Å. A heat treatment of the fiber for about 1 hr in an oven maintained at 3300° C. gave a tensile modulus of $126\times10^6$ psi, a resistivity of 1.73 micro-ohm-meter and a density of 2.180 g/cc.

Comparative Example "F". A commercial high modulus, continuous pitch-based carbon fiber was obtained from Amoco Performance Products Inc. as Thornel P-75 carbon fiber having a tensile strength of 279 kpsi, a tensile modulus of $73\times10^6$ psi, a resistivity of 7.12 micro-ohm-meter, a density of 2.085 g/cc, and a d spacing Co (004) of 3.418 Å. After the fiber was heat treated for about 2 hrs in an oven maintained at 3010° C., the tensile modulus was $113\times10^6$ psi, the resistivity was measured as 2.52 micro-ohm-meter, the density was 2.175 and the d spacing Co (004) was 3.382 Å.

Comparative Example "G". A commercial high modulus continuous pitch-based carbon fiber was obtained from Amoco Performance Products Inc. as Thornel P-55 carbon fiber having a tensile strength of 315 kpsi, a tensile modulus of $56\times10^6$ psi, a resistivity of 8.73 micro-ohm-meter, a density of 2.035 g/cc, and a d spacing Co (004) of 3.429 Å. After the fiber was heat treated about 1 hr in an oven maintained at 3000° C., the tensile modulus was $101\times10^6$ psi, the resistivity was measured as 2.27 micro-ohm-meter, the density was 2.163 and the d spacing Co (004) was 3.377 Å. A heat treatment of the fiber for about 1 hr in an oven maintained at 3300° C. gave a tensile modulus of $123\times10^6$ psi a resistivity of 1.81 micro-ohm-meter and a density of 2.183 g/cc.

From a consideration of Comparative Examples "D-G" it will be apparent that extended heating of prior art carbon fiber may serve to reduce the high electrical resistivity and improve the modulus of such fibers, apparently by reducing the amorphous carbon character of the fiber as shown by the decreased d spacing. However, it will be seen that the properties of prior art fibers appear to approach limiting values during the thermal treatment, and that an increase in thermal treatment alone is not sufficient to provide carbon fibers having the modulus and thermal properties exhibited by the fibers of this invention.

It will thus be seen that the present invention is a pitch-based continuous carbon fiber having a density of not less than 2.18 g/cc, a tensile modulus substantially above $120\times10^6$ psi, and an electrical resistivity below about 1.6 micro-ohm-meter. More particularly, the invention is a continuous carbon fiber having a density in the range of from about 2.18 g/cc to the limiting density of crystalline graphite, about 2.26 g/cc, a tensile modulus in the range of from about $125\times10^6$ psi to about $150\times10^6$ psi, and an electrical resistivity in the range of from 1.5 to about 0.95. The thermal conductivity of the continuous carbon fibers of this invention lies in the range of about 950 to about 1800 w/m-°K, generally above about.1000 w/m-°K and more preferably above 1100 w/m-°K, and the fibers thus are particularly attractive for use in fiber reinforced composites where good dimensional stability and dissipation of heat is desired. The present invention is further directed to methods for making such carbon fiber and to composites comprising such carbon fiber. It will be recognized by those skilled in the art that further modifications, particularly in the processes described for making the continuous pitch-based carbon fibers of this invention, may be made without departing from the spirit and scope of the invention, which is solely defined by the appended claims.

We claim:

1. A continuous, pitch-based carbon fiber having a tensile modulus greater than $125\times10^6$ psi, an electrical resistivity less than 1.6 micro-ohm-meter and a density greater than 2.18 g/cc.

2. The carbon fiber of claim 1 wherein said carbon fiber is a continuous, pitch-based carbon fiber having a tensile modulus greater than $130\times10^6$ psi and an electrical resistivity less than 1.5 micro-ohm-meter

3. The carbon fiber of claim 1 wherein said carbon fiber is a continuous, pitch-based carbon fiber having a tensile modulus greater than $130\times10^6$ psi and an electrical resistivity less than 1.2 micro-ohm-meter.

4. The carbon fiber of claim 1 wherein said carbon fiber has a density not less than 2.2 g/cc.

5. A continuous, pitch-based carbon fiber having a tensile modulus in the range of from about $125\times10^6$ to about $150\times10^6$ psi, an electrical resistivity of from about 1.6 to about 0.95 micro-ohm-meter and a density of from about 2.19 to about 2.26 g/cc.

6. The carbon fiber of claim 5 having an electrical resistivity less than about 1.2 micro-ohm-meter and a density not less than 2.2 g/cc.

7. The carbon fiber of claim 5 having a thermal conductivity greater than about 1000 w/m-°K.

8. The carbon fiber of claim 5 having an electrical resistivity less than about 1.2 microohm-meter, a density not less than 2.2 g/cc and a thermal conductivity greater than about 1100 w/m-°K.

* * * * *